US008624942B2

(12) United States Patent
Jeon

(10) Patent No.: US 8,624,942 B2
(45) Date of Patent: Jan. 7, 2014

(54) LUMINANCE CORRECTION SYSTEM FOR ORGANIC LIGHT EMITTING DISPLAY

(75) Inventor: Dae-Sick Jeon, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 337 days.

(21) Appl. No.: 13/021,648

(22) Filed: Feb. 4, 2011

(65) Prior Publication Data

US 2012/0062609 A1 Mar. 15, 2012

(30) Foreign Application Priority Data

Sep. 14, 2010 (KR) ..... 10-2010-0089948

(51) Int. Cl.
*G09G 5/10* (2006.01)

(52) U.S. Cl.
USPC ..... 345/690; 345/77

(58) Field of Classification Search
USPC ..... 345/76, 77, 589–591, 600, 601, 345/690–692
See application file for complete search history.

(56) References Cited

U.S. PATENT DOCUMENTS

| | | | | |
|---|---|---|---|---|
| 7,495,679 | B2 * | 2/2009 | Chou | 345/690 |
| 8,184,134 | B2 * | 5/2012 | Asao et al. | 345/690 |
| 2006/0001624 | A1 * | 1/2006 | Lee | 345/82 |
| 2006/0221029 | A1 * | 10/2006 | Hsu et al. | 345/88 |
| 2006/0250412 | A1 * | 11/2006 | Chen et al. | 345/589 |
| 2007/0052735 | A1 * | 3/2007 | Chou | 345/690 |
| 2009/0195483 | A1 * | 8/2009 | Naugler et al. | 345/76 |
| 2009/0278773 | A1 * | 11/2009 | Chegal | 345/77 |
| 2009/0304274 | A1 * | 12/2009 | Yoshii et al. | 382/167 |
| 2010/0265279 | A1 * | 10/2010 | Lee | 345/690 |
| 2011/0050749 | A1 * | 3/2011 | Park | 345/690 |
| 2011/0063269 | A1 * | 3/2011 | Lee | 345/207 |
| 2011/0109661 | A1 * | 5/2011 | Lee | 345/690 |
| 2011/0227955 | A1 * | 9/2011 | Lee et al. | 345/690 |
| 2012/0242680 | A1 * | 9/2012 | Park | 345/590 |

FOREIGN PATENT DOCUMENTS

| | | | |
|---|---|---|---|
| KR | 10-2004-0077353 | A | 9/2004 |
| KR | 10-2005-0038914 | A | 4/2005 |
| KR | 10-2009-0025896 | A | 3/2009 |
| KR | 10-2009-0049496 | A | 5/2009 |

* cited by examiner

*Primary Examiner* — Dmitriy Bolotin
(74) *Attorney, Agent, or Firm* — Christie, Parker & Hale, LLP

(57) ABSTRACT

There is provided a luminance correction system for an organic light emitting display, in which reference offset values are set in order to correct gamma voltages of reference gray scale levels and an additional offset value is set for at least one gray scale level among the remaining gray scale levels other than the reference gray scale levels to apply the offset value to the correction of the gamma voltage corresponding to the gray scale level so as to prevent color coordinates from being distorted in the respective gray scale levels and luminance components.

8 Claims, 5 Drawing Sheets

| | Module #1 | | Module #2 | | Module #3 | | Module #4 | |
|---|---|---|---|---|---|---|---|---|
| | Color coordinates | Luminance (cd/cm$^2$) | Color coordinates | Luminance (cd/cm$^2$) | Color coordinates | Luminance (cd/cm$^2$) | Color coordinates | Luminance (cd/cm$^2$) |
| Gray scale 255 | 0.295,0.320 | 304 | 0.296,0.321 | 296 | 0.295,0.317 | 300 | 0.297,0.322 | 306 |
| Gray scale 168 | 0.299,0.310 | 118 | 0.302,0.310 | 115 | 0.300,0.306 | 113 | 0.302,0.314 | 119 |
| Gray scale 127 | 0.298,0.322 | 59.5 | 0.298,0.319 | 57 | 0.297,0.320 | 56 | 0.299,0.318 | 59 |
| Gray scale 40 | 0.307,0.313 | 5.8 | 0.303,0.317 | 4.96 | 0.299,0.314 | 4.24 | 0.305,0.303 | 4.9 |
| Gray scale 12 | 0.304,0.335 | 0.9 | 0.311,0.337 | 0.6 | 0.287 | 0.366 | 0.311,0.334 | 0.61 |

FIG. 5

| Reference offset value | R | G | B | Reference offset value | R | G | B |
|---|---|---|---|---|---|---|---|
| | a | b | c | | a | b | c |
| −16 | 1 | 2 | 1 | 0 | 0 | 0 | 0 |
| −15 | 1 | 2 | 1 | 1 | 0 | 0 | 0 |
| −14 | 1 | 2 | 1 | 2 | 0 | 0 | 0 |
| −13 | 1 | 2 | 1 | 3 | 0 | 0 | 0 |
| −12 | 1 | 2 | 1 | 4 | 0 | 0 | 0 |
| −11 | 1 | 2 | 1 | 5 | 0 | 0 | 0 |
| −10 | 1 | 1 | 1 | 6 | 0 | 0 | 0 |
| −9 | 1 | 1 | 1 | 7 | 0 | 0 | 0 |
| −8 | 0 | 1 | 0 | 8 | 0 | −1 | 0 |
| −7 | 0 | 1 | 0 | 9 | 0 | −1 | 0 |
| −6 | 0 | 1 | 0 | 10 | 0 | −1 | 0 |
| −5 | 0 | 0 | 0 | 11 | −1 | −2 | 0 |
| −4 | 0 | 0 | 0 | 12 | −1 | −2 | −1 |
| −3 | 0 | 0 | 0 | 13 | −1 | −2 | −1 |
| −2 | 0 | 0 | 0 | 14 | −2 | −3 | −2 |
| −1 | 0 | 0 | 0 | 15 | −2 | −3 | −2 |
| 0 | 0 | 0 | 0 | 16 | −2 | −3 | −1 |

FIG. 6

| | | Module #1 | | Module #2 | | Module #3 | | Module #4 | |
|---|---|---|---|---|---|---|---|---|---|
| | | Color coordinates | Luminance (cd/cm$^2$) | Color coordinates | Luminance (cd/cm$^2$) | Color coordinates | Luminance (cd/cm$^2$) | Color coordinates | Luminance (cd/cm$^2$) |
| Gray scale 255 | Before correcting | 0.295,0.320 | 304 | 0.296,0.321 | 296 | 0.295,0.317 | 300 | 0.297,0.322 | 306 |
| | After correcting | 0.295,0.320 | 305 | 0.296,0.321 | | 0.295,0.318 | | 0.297,0.322 | 306 |
| Gray scale 168 | Before correcting | 0.299,0.310 | 118 | 0.302,0.310 | 115 | 0.300,0.306 | 113 | 0.302,0.310 | 119 |
| | After correcting | 0.299,**0.315** | 120 | 0.301,**0.314** | 117 | 0.300,**0.311** | 115 | 0.303,**0.314** | 121 |
| Gray scale 127 | Before correcting | 0.298,0.322 | 59.5 | 0.298,0.319 | 57 | 0.297,0.320 | 56 | 0.299,0.318 | 59 |
| | After correcting | 0.297,0.326 | 60.4 | 0.298,0.323 | 59 | 0.299,0.324 | 57 | 0.297,0.322 | 60 |
| Gray scale 40 | Before correcting | 0.307,0.313 | 5.8 | 0.303,0.310 | 4.96 | 0.299,0.314 | 4.24 | 0.305,0.303 | 4.9 |
| | After correcting | 0.305,**0.317** | | 0.303,**0.315** | 5.1 | 0.299,**0.318** | 4.47 | 0.303,**0.306** | 5.0 |
| Gray scale 12 | Before correcting | 0.304,0.335 | 0.9 | 0.311,0.337 | 0.9 | 0.287,0.355 | 0.52 | 0.311,0.334 | 0.61 |
| | After correcting | 0.303,**0.341** | | 0.309,**0.340** | | 0.287,**0.369** | | 0.310,**0.337** | |

LUMINANCE CORRECTION SYSTEM FOR ORGANIC LIGHT EMITTING DISPLAY

CROSS-REFERENCE TO RELATED APPLICATION

This application claims priority to and the benefit of Korean Patent Application No. 10-2010-0089948, filed on Sep. 14, 2010, in the Korean Intellectual Property Office, the entire content of which is incorporated herein by reference.

BACKGROUND

1. Field

Embodiments of the present invention relate to a luminance correction system, and more particularly, to a luminance correction system applied to an organic light emitting display.

2. Description of the Related Art

An organic light emitting display is a type of a flat panel display (FPD), in which an organic compound is used as an emission material, has high luminance and color purity, is thin and light, is driven with low power consumption, and may be used for various displays such as a portable display.

Organic light emitting displays generate data signals having voltages in accordance with the respective gray scale levels based on reference gamma voltages and displays an image corresponding to the generated data signals. The luminance components of the respective completed processes may be different from the target luminance due to variations in manufacturing processes.

When the luminance components of the products whose manufacturing products are completed do not reach the target value, the products are determined as being defective. Therefore, in FPDs (e.g., completed FPDs) the measured luminance components of the respective products are to be corrected to be suitable for the target luminance.

When only the luminance of the organic light emitting display is corrected, due to difference in efficiency, among red pixels, green pixels, and blue pixels, a white balance may be distorted. Therefore, in order to solve such a problem, color coordinates may be corrected together with the luminance.

Conventionally, the luminance and the color coordinates are corrected only for predetermined reference gray scale levels and the offset value generated during the correction of the reference gray scale levels is directly applied to other gray scale levels. In this case, correction close to the target value is performed in the reference gray scale levels. However, for other gray scale levels, especially those gray scale levels that are remote from the reference gray scale levels, the luminance and the color coordinates of the gray scale level become different from the target value.

SUMMARY

Accordingly, aspects of embodiments of the present invention provide a luminance correction system for an organic light emitting display, in which reference offset values are set in order to correct gamma voltages of reference gray scale levels and an additional offset value is set for at least one gray scale level among the remaining gray scale levels other than the reference gray scale levels to apply the offset value to the correction of the gamma voltage corresponding to the gray scale level so that it is possible to prevent color coordinates from being twisted (e.g., distorted) in the respective gray scale levels and luminance components.

In order to achieve the foregoing and/or other aspects of the present invention, there is provided a luminance correction system for an organic light emitting display, including: a screen analyzing unit configured to analyze a screen displayed on a display unit of the organic light emitting display to measure luminance and color coordinates for reference gray scale levels; a reference offset value setting unit configured to set reference offset values for the reference gray scale levels to correspond to a screen analyzing result obtained by the screen analyzing unit; a gamma voltage correcting unit configured to correct reference gamma voltages for the reference gray scale levels to correspond to the reference offset values set by the reference offset value setting unit and to output the corrected reference gamma voltages; and a gamma voltage applying unit configured to apply the reference gamma voltages corrected by the gamma voltage correcting unit to the data driver of the organic light emitting display.

The reference gray scale levels may be set to be a maximum gray scale level and a medium gray scale level.

The screen analyzing unit may include: a measuring unit configured to measure chrominance and luminance of the screen; a color coordinate determining unit configured to determine color coordinates based on the measured chrominance; and a luminance comparing unit configured to obtain a difference between a target luminance and a measured luminance.

The reference offset value setting unit may be further configured to set reference luminance offset values that have luminance controlled to correspond to a difference between measured luminance and target luminance for reference gray scale levels obtained by the luminance comparing unit and reference color coordinate offset values that have chrominance controlled to correspond to color coordinates for the reference gray scale levels obtained by the color coordinate determining unit.

The gamma voltage correcting unit may be further configured to add reference offset values to the reference gamma voltages to control the reference gamma voltages.

The luminance correction system may further include: an additional offset value setting unit configured to set an additional offset value for at least one gray scale level among gray scale levels other than the reference gray scale levels; and a storage unit configured to store a lookup table from which additional offset values of red, green, and blue pixels are determined based on the reference offset value.

When the reference offset values are negative (−) values, additional offset values corresponding to the reference offset values may be 0 or positive (+) values. Gamma voltages for gray scale levels, other than the reference gray scale levels, may be corrected by adding together the reference offset values and the additional offset values.

As described above, according to embodiments of the present invention, in order to correct gamma voltages of reference gray scale levels, reference offset values are set and the additional offset value is set for at least one gray scale level among the remaining gray scale levels other than the reference gray scale levels so that the offset value is applied to the correction of the gamma voltage corresponding to the gray scale level and that it is possible to prevent the color coordinates from being distorted in the respective gray scale levels and luminance components.

BRIEF DESCRIPTION OF THE DRAWINGS

The accompanying drawings, together with the specification, illustrate exemplary embodiments of the present invention, and, together with the description, serve to explain the principles of the present invention.

FIG. 5 is a view illustrating an example of a lookup table provided in the luminance correction system as illustrated in FIG. 4; and FIG. 6 is experimental data representing luminance and color coordinate characteristics corrected by a luminance correction system as illustrated in FIG. 4.

DETAILED DESCRIPTION

Figure 1:
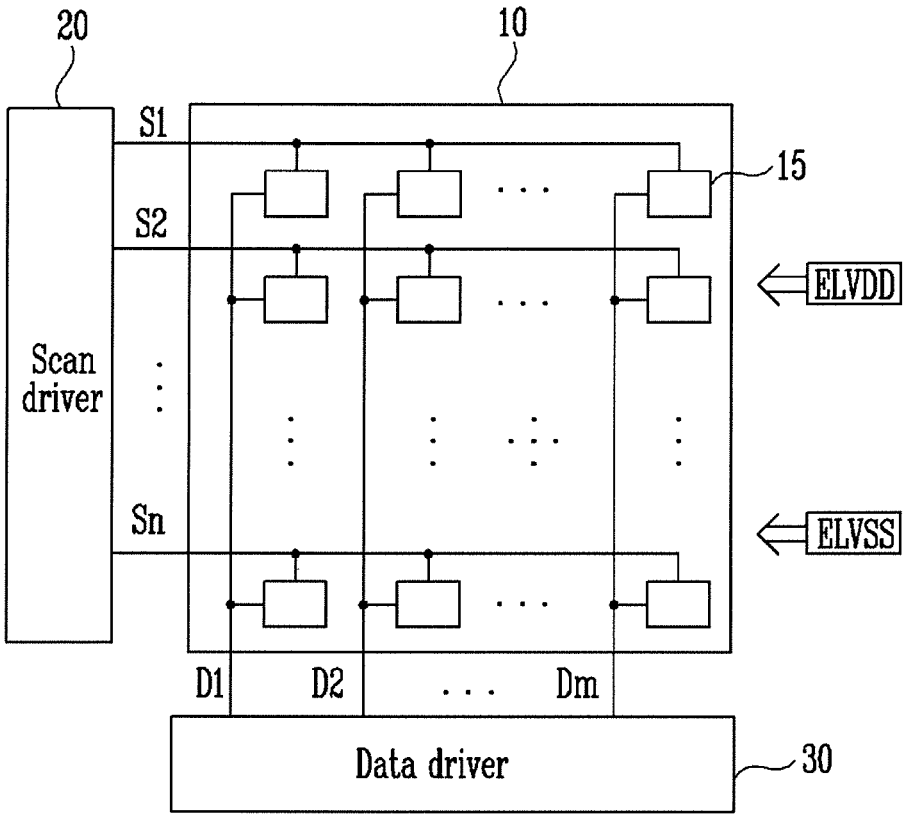
FIG. 1 is a block diagram illustrating the structure of an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

FIG. 1 is a block diagram illustrating the structure of an organic light emitting display according to an embodiment of the present invention.

Referring to FIG. 1, the organic light emitting display according to the embodiment of the present invention includes a display unit 10, a scan driver 20, and a data driver 30.

The display unit 10 includes a plurality of pixels 15 arranged at the crossing regions of scan lines S1 to Sn and data lines D1 to Dm and receives power from driving power sources such as a high potential pixel power source ELVDD and a low potential pixel power source ELVSS from the outside (e.g., from an outside power source supplying unit).

The pixels 15 included in the display unit 10 store data signals supplied from data lines D coupled thereto when scan signals are supplied from scan lines S coupled thereto, and emit light with luminance components corresponding to the data signals. Therefore, images corresponding to the data signals are displayed on the display unit 10.

The scan driver 20 sequentially generates scan signals to correspond to scan control signals supplied from the outside (e.g., a timing controller). The scan signals generated by the scan driver 20 are supplied to the pixels 15 through the scan lines S1 to Sn.

The data driver 30 generates data signals to correspond to data and data control signals supplied from the outside (e.g., the timing controller). The data signals generated by the data driver 30 are supplied to the pixels 15 through the data lines D1 to Dm in synchronization with the scan signals.

The data driver 30 generates data signals having voltages in accordance with the gray scale levels of data based on a gamma voltage (e.g., a predetermined gamma voltage). When dispersion is generated in panel characteristics due to variations in manufacturing processes, images with different luminance components may be displayed on panels for the same data signal. Therefore, in the organic light emitting displays as completed products, the measured luminance components of the respective products are to be corrected to be suitable for the target luminance.

Therefore, according to an embodiment of the present invention, a luminance correction system is provided in which a difference in luminance generated by dispersion of the characteristics of the panels of the organic light emitting displays is corrected so that the respective panels may have the same luminance.

Figures 2, 3:
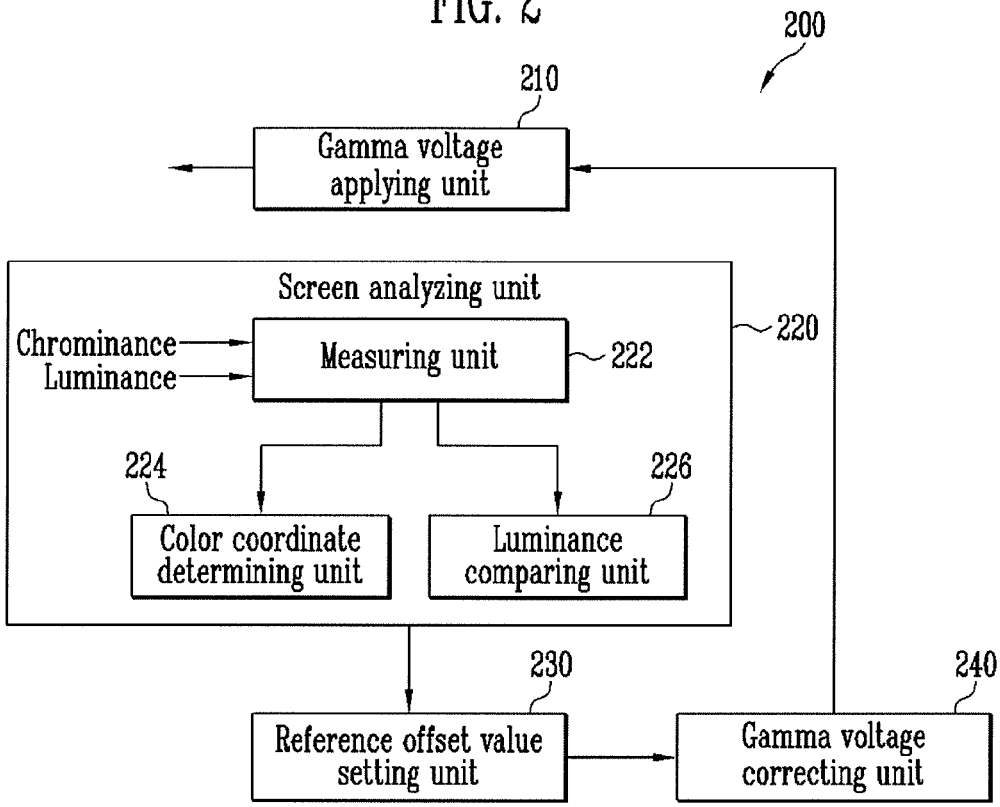
FIG. 2 is a block diagram illustrating a luminance correction system according to an embodiment of the present invention.
FIG. 3 is experimental data illustrating luminance and color coordinate characteristics corrected by a luminance correction system as illustrated in FIG. 2.

FIG. 2 is a block diagram illustrating a luminance correction system according to an embodiment of the present invention.

Referring to FIG. 2, a luminance correction system 200, according to an embodiment of the present invention, includes a screen analyzing unit 220, a reference offset value setting unit 230, a gamma voltage correcting unit 240, and a gamma voltage applying unit 210. The luminance correction system 200 may be applied to correct the luminance and color coordinates of the organic light emitting display.

The screen analyzing unit 220 analyzes a screen displayed on the display unit of the organic light emitting display to measure luminance and color coordinates for reference gray scale levels.

According to an embodiment of the present invention, when data are realized by 256 gray scale levels, that is, gray scale levels (e.g., gray scale levels or gray scale values) 0 to 255, the reference gray scale levels may be the gray scale level 255 and the gray scale level 127.

That is, with the data of the highest gray scale level (the gray scale level 255), data of the other gray scale level at the inflection point displayed on a luminance curve in accordance with gray scale levels, for example, the data of the gray scale level 127 may be further applied to the panel. In this case, since screen analysis for a plurality of gray scale levels may be performed, the precision degree of luminance correction may be improved.

In addition, the screen analyzing unit 220 may include a measuring unit 222 for measuring the chrominance and the luminance of a screen, a color coordinate determining unit 224 for determining color coordinates based on the measured chrominance, and a luminance comparing unit 226 for obtaining a difference between target luminance (e.g., a predetermined target luminance) and measured luminance based on the measured luminance.

The reference offset value setting unit 230 sets reference offset values for the reference gray scale levels to correspond to screen analyzing results obtained by the screen analyzing unit.

In detail, the reference offset value setting unit 230 may set reference luminance offset values for controlling luminance to correspond to a difference between the reference gray scale levels obtained by the luminance comparing unit 226 and the target luminance and reference color coordinate offset values for controlling chrominance to correspond to color coordinates for the reference gray scale levels obtained by the color coordinate determining unit 224.

For example, the reference offset value setting unit 230 sets gamma control values capable of compensating for a difference between the target luminance and the measured luminance as reference luminance offset values and may set color coordinate movement values capable of correcting color coordinates distorted by problems in luminance correction or processes as reference color coordinate offset values.

Here, the reference offset value setting unit 230 may determine the offset value corresponding to a luminance difference and/or color coordinates by, for example, an equation (e.g., a predetermined equation) or graph.

The gamma voltage correcting unit 240 corrects reference gamma voltages for the reference gray scale levels to correspond to the reference offset values set by the reference offset value setting unit 230 and supplies the corrected reference gamma voltage to the gamma voltage applying unit.

In particular, the gamma voltage correcting unit 240 may correct luminance by controlling the reference gamma voltages to correspond to the reference luminance offset values. For example, the reference gamma voltages are controlled by the sums of the reference gamma voltages and the reference luminance offset values to correct luminance. Here, the reference luminance offset values are set to negative (−) values so that luminance may be reduced when the measured luminance is higher than the target luminance, and may be set to positive (+) values so that luminance may be increased when the measured luminance is lower than the target luminance.

Here, the reference gamma voltages are ideal gamma voltages corresponding to (e.g., predetermined to correspond to) the above-described reference gray scale levels, which are ideal gamma voltages in which variations between the characteristics of panels are not considered. As described above, when the reference offset values are applied to the reference gamma voltages, variations in the characteristics of the panels may be compensated for.

In addition, the gamma voltage correcting unit 240 controls color coordinates using the reference color coordinate offset values to correct chrominance.

Here, chrominance correction may be simultaneously performed with luminance correction according to (or corresponding to) a result of analyzing a screen. However, the chrominance correction may be performed by controlling color coordinates after first performing luminance correction, and then analyzing the screen corresponding to the luminance correction result. In this case, the color coordinates distorted by the luminance correction may also be corrected (e.g., compensated for) so that the variations in the characteristics of the panels may be corrected more effectively.

The gamma voltage applying unit 210 applies the gamma voltages may be corrected by the gamma voltage correcting unit 240, that is, the reference gamma voltages corrected in accordance with the reference gray scale levels to the data driver of the organic light emitting display. Here, the corrected reference gamma voltages are realized by the sums of the reference gamma voltages and the reference offset values as described above.

FIG. 3 is experimental data illustrating luminance and color coordinate characteristics corrected by the luminance correction system of FIG. 2.

As illustrated in FIG. 3, the experimental data illustrate results of correcting the gamma voltages of four different panels and of providing the corrected gamma voltages to the panels. Not only the luminance and color coordinate characteristics for the above-described reference gray scale levels, that is, the gray scale level 255 and the gray scale level 127, but also the luminance and color coordinate characteristics for gray scale levels (the gray scale level 168, the gray scale level 40, and the gray scale level 12) other than the reference gray scale levels, are shown in FIG. 3.

Here, for example, the target white color coordinates (x, y) for the gray scale levels of the panels are (0.297, 0.320).

Referring to FIG. 3, the measured color coordinates for the corrected reference gray scale levels, that is, the gray scale level 255 and the gray scale level 127, are considerably close to the target color coordinates. However, the measured color coordinates for the remaining gray scale levels are different from the target color coordinates.

In more detail, for the remaining gray scale levels, the y color coordinate of the white color coordinates (x, y) is shifted too far to the left. This is because gamma voltages applied to green pixels are excessively reduced in the gray scale levels other than the reference gray scale levels where correction is not directly performed since the reference offset values for the green pixels are shifted too far to negative (−) values.

According to another embodiment of the present invention, in order to perform gamma value correction for the reference gray scale levels, the reference offset values are set, an additional offset value for at least one gray scale level among the remaining gray scale levels other than the reference gray scale levels is set, and the reference offset values and the additional offset value are applied to the gamma voltage correction corresponding to the gray scale level so that it is possible to prevent color coordinates from being distorted in the gray scale levels and luminance.

Figure 4:
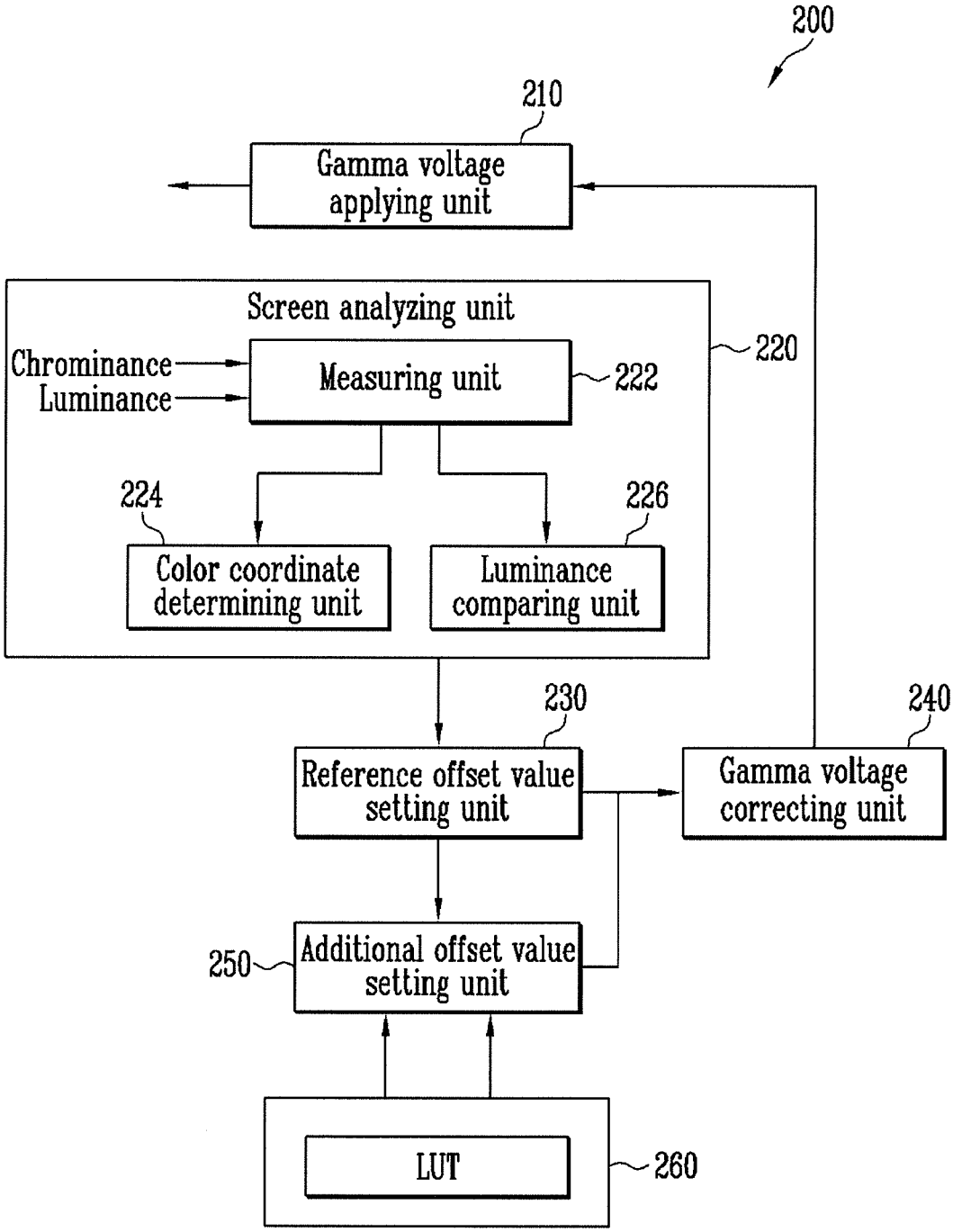
FIG. 4 is a block diagram illustrating a luminance correction system according to another embodiment of the present invention.

FIG. 4 is a block diagram illustrating a luminance correction system according to another embodiment of the present invention. FIG. 5 is a view illustrating an example of a lookup table provided in the luminance correction system of FIG. 4.

The same elements as those of the embodiment of FIG. 2 are denoted by the same reference numerals and description of the same elements will be omitted.

Referring to FIG. 4, a brightness correction system 200 according to another embodiment of the present invention further includes the screen analyzing unit 220, the reference offset value setting unit 230, the gamma voltage correcting unit 240, and the gamma voltage applying unit 210. The brightness correction system 200 also includes an additional offset value setting unit 250 and a storage unit 260.

The additional offset value setting unit 250 sets additional offset values for the gray scale levels other than the reference gray scale levels, and not the reference offset values for the reference gray scale levels, that is, the gray scale level 255 and the gray scale level 127. The additional offset values are set based on the reference offset values.

The gray scale levels to which the additional offset values are applied may be the gray scale level 168 between the gray scale level 255 and the gray scale level 127 and/or the gray scale level 40 as a low gray scale level.

According to one embodiment of the present invention, the gamma voltage for the gray scale level 168 is additionally corrected.

Therefore, the reference offset value for the reference gamma voltage corresponding to the reference gray scale level, that is, the gray scale level 255 is set so that the reference gamma voltage and the reference offset value are added to generate a corrected reference gamma voltage, which is the same, or substantially the same as the structure and the operation of the embodiment of FIG. 2.

That is, for the gray scale level 255, the reference offset values applied to red, green, and blue pixels are set through the above process.

Then, an additional offset value is set for the gray scale level 168 with reference to the set reference offset value. When the additional offset value is set, the gamma voltage for the gray scale level 168 is corrected by adding the reference offset value and the additional offset value and the corrected gamma voltage is output to the data driver.

Here, the additional offset value is set with reference to the lookup table LUT stored in the storage unit 260.

The lookup table LUT may be realized, for example, by selecting a plurality of panels as models and by experimentally evaluating how much color coordinates for lower gray scale levels deviate from the target color coordinates in comparison with the reference gray scale level for the reference offset value applied to the red, green, and blue pixels.

Referring to FIG. 5, the lookup table LUT may be implemented to determine additional offset values (a, b, c) from red (R), green (G), and blue (B) pixels for the reference offset value.

For example, when the reference offset value is −16, the additional offset value for the red (R) pixel is 1, the additional offset value (b) for the green pixel (G) is 2, and the additional offset value (c) for the blue pixel B is 1.

In addition, when the reference offset value is 16, the additional offset value (a) for the red pixel (R) is −2, the additional offset value (b) for the green (G) pixel is −3, and the additional offset value (c) for the blue pixel (B) is −1.

The additional offset values are applied to the gray scale levels other than the reference gray scale level using the lookup table LUT so that it is possible to prevent the gamma voltage applied to the green pixel from being excessively reduced in the gray scale levels other than the reference gray scale level where correction is not directly performed since the reference offset value for the green (G) pixel is shifted too far to a negative (−) value.

That is, when it is assumed that the reference offset value is −16, since the additional offset value (b) for the green (G) pixel is 2, it is possible to prevent correction from being performed in the state where the gamma voltage applied to the corresponding gray scale level is excessively reduced.

FIG. 6 is a view illustrating experimental data representing luminance and color coordinate characteristics corrected by the luminance correction system of FIG. 4.

As illustrated in FIG. 6, the experimental data illustrate results of correcting the gamma voltages of four different panels and of providing the corrected gamma voltages to the panels. Not only the luminance and color coordinate characteristics for the above-described reference gray scale levels, that is, the gray scale level 255 and the gray scale level 127 but also the luminance and color coordinate characteristics for the gray scale levels (the gray scale level 168, the gray scale level 40, and the gray scale level 12) other than the reference gray scale levels, are described.

Here, the target white color coordinates (x, y) for the gray scale levels of the panels are (0.297, 0.320).

Referring to FIG. 6, the measured color coordinates for the corrected reference gray scale levels, that is, the gray scale level 255 and the gray scale level 127, are considerably close to the target color coordinates, and the measured color coordinates for the remaining gray scale levels corrected with reference to the additional offset values are considerably close to the target color coordinates.

That is, the additional offset values are applied to the gray scale levels other than the reference gray scale level so that it is possible to prevent the reference offset value for the green pixel from being shifted too far to the negative (−) value and that it is possible to prevent the y color coordinate of the white color coordinates (x, y) from being shifted too far to the left.

The present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A luminance correction system for an organic light emitting display, comprising:

a screen analyzing unit configured to analyze a screen displayed on a display unit of the organic light emitting display to measure luminance and color coordinates for reference gray scale levels;

a reference offset value setting unit configured to set reference offset values for the reference gray scale levels to correspond to a screen analyzing result obtained by the screen analyzing unit;

a gamma voltage correcting unit configured to correct reference gamma voltages for the reference gray scale levels to correspond to the reference offset values set by the reference offset value setting unit and to output the corrected reference gamma voltages;

a gamma voltage applying unit configured to apply the reference gamma voltages corrected by the gamma voltage correcting unit to a data driver of the organic light emitting display; and an additional offset value setting unit configured to set an additional offset value for at least one gray scale level among gray scale levels other than the reference gray scale levels; and a storage unit configured to store a lookup table from which additional offset values of red, green, and blue pixels are determined based on the reference offset value.

2. The luminance correction system claimed in claim 1, wherein the reference gray scale levels are set to a maximum gray scale level and a medium gray scale level.

3. The luminance correction system as claimed in claim 1, wherein the screen analyzing unit comprises:

a measuring unit configured to measure chrominance and the luminance of the screen;

a color coordinate determining unit configured to determine the color coordinates based on the measured chrominance; and a luminance comparing unit configured to obtain a difference between a target luminance and a measured luminance.

4. The luminance correction system as claimed in claim 3, wherein the reference offset value setting unit is further configured to set reference luminance offset values that have luminance controlled to correspond to the difference between the measured luminance and the target luminance for reference gray scale levels obtained by the luminance comparing unit, and reference color coordinate offset values that have chrominance controlled to correspond to the color coordinates for the reference gray scale levels obtained by the color coordinate determining unit.

5. The luminance correction system as claimed in claim 1, wherein the gamma voltage correcting unit is further configured to add reference offset values to the reference gamma voltages to control the reference gamma voltages.

6. The luminance correction system as claimed in claim 1, wherein, when the reference offset values are negative (−) values, additional offset values corresponding to the reference offset values are 0 or positive (+) values.

7. The luminance correction system as claimed in claim 1, wherein gamma voltages for gray scale levels other than the reference gray scale levels are corrected by adding the reference offset values and the additional offset values to each other.

8. A luminance correction system for an organic light emitting display, comprising:

a screen analyzing unit configured to analyze a screen displayed on a display unit of the organic light emitting display to measure luminance and color coordinates for at least two reference gray scale levels that which are fewer than a total number of gray scale levels in the displayed screen;

a reference offset value setting unit configured to set reference offset values for the reference gray scale levels to correspond to a screen analyzing result obtained by the screen analyzing unit;

a gamma voltage correcting unit configured to correct reference gamma voltages for the reference gray scale levels to correspond to the reference offset values set by the reference offset value setting unit and to output the corrected reference gamma voltages; and a gamma voltage applying unit configured to apply the reference gamma voltages corrected by the gamma voltage correcting unit to a data driver of the organic light emitting display.

* * * * *

UNITED STATES PATENT AND TRADEMARK OFFICE

CERTIFICATE OF CORRECTION

PATENT NO. : 8,624,942 B2
APPLICATION NO. : 13/021648
DATED : January 7, 2014
INVENTOR(S) : Dae-Sick Jeon It is certified that error appears in the above-identified patent and that said Letters Patent is hereby corrected as shown below:

In the Claims

Column 9, line 1, Claim 8 Delete "which"

Signed and Sealed this
Fifteenth Day of December, 2015

Michelle K. Lee

Michelle K. Lee
*Director of the United States Patent and Trademark Office*